US010221572B2

(12) United States Patent
Houser

(10) Patent No.: US 10,221,572 B2
(45) Date of Patent: Mar. 5, 2019

(54) VINYL SIDING CORNER SHIELD

(71) Applicant: Kristopher Houser, Davenport, IA (US)

(72) Inventor: Kristopher Houser, Davenport, IA (US)

( * ) Notice: Subject to any disclaimer, the term of this patent is extended or adjusted under 35 U.S.C. 154(b) by 0 days.

(21) Appl. No.: 15/813,380

(22) Filed: Nov. 15, 2017

(65) Prior Publication Data

US 2018/0135308 A1 May 17, 2018

Related U.S. Application Data

(60) Provisional application No. 62/422,888, filed on Nov. 16, 2016.

(51) Int. Cl.
*E04F 13/073* (2006.01)
*E04F 13/18* (2006.01)

(52) U.S. Cl.
CPC ..... *E04F 13/0733* (2013.01); *E04F 13/18* (2013.01); *E04F 2203/023* (2013.01)

(58) Field of Classification Search
CPC ..... E04F 13/0733; E04F 2203/023; E04F 13/0736
USPC ..... 52/204.56, 204.57, 204.58, 204.71
See application file for complete search history.

(56) References Cited

U.S. PATENT DOCUMENTS 2,942,703 A * 6/1960 Nelsson ..... E06B 1/34 52/459
3,010,548 A * 11/1961 Canalini ..... E06B 3/88 52/285.3
3,717,968 A * 2/1973 Olsen ..... E04F 19/028 52/288.1
3,742,668 A * 7/1973 Oliver ..... E04F 19/028 52/288.1
6,405,498 B1 * 6/2002 Riegelman ..... E06B 3/66342 52/171.3

* cited by examiner

*Primary Examiner* — Patrick J Maestri
(74) *Attorney, Agent, or Firm* — Zarley Law Firm, P.L.C.

(57) ABSTRACT

A cover shield for the corner edge of a corner post of a structure having an elongated sheet of material folded in half along a first fold line to form a 90 degree angle. Both ends of the sheet are folded along second and third fold lines, to form a first and a second flap. First and second flaps are frictionally connected to the corner edges of the corner post.

8 Claims, 8 Drawing Sheets

VINYL SIDING CORNER SHIELD

CROSS REFERENCE TO RELATED APPLICATION

This application claims the benefit to Provisional Application U.S. Ser. No. 62/422,888 filed on Nov. 16, 2016.

BACKGROUND OF THE INVENTION

This invention is directed to a corner shield for a structure and more particularly a corner shield for vinyl siding.

Well known in the art is the use of vinyl siding as a protective outer layer of material for structures such as homes and the like. Over time, the vinyl siding at the corner of a structure can become damaged. This is particularly the case when landscape work using landscape tools such as string trimmers, shovels, brooms, and the like are used around the corner of the structure. To protect the corner of a structure with vinyl siding can be challenging, as siding comes in different shapes and sizes. Accordingly, a need exists in the art for a device that protects a vinyl corner or is used to repair a vinyl corner.

An objective of the present invention is to provide a corner shield that is easy to apply to a corner post.

Another objective of the present invention is to provide a corner shield that is adjustable.

These and other objectives will be apparent to those having ordinary skill in the art based upon the following written description, drawings and claims.

SUMMARY OF THE INVENTION

A corner shield for a corner post of a structure having a pliable elongated sheet of material. The sheet is folded in half along a first fold line preferably to form a 90 degree angle. Formed along a second fold line of an end of the sheet is a first flap. Formed along a third fold line at an opposite end of the sheet is a second flap.

The flaps are frictionally fitted to the corner edge of a corner post. Alternatively, the corner shield is made of three pieces adjustably fitted together.

DETAILED DESCRIPTION OF THE PREFERRED EMBODIMENT

Figure 1:
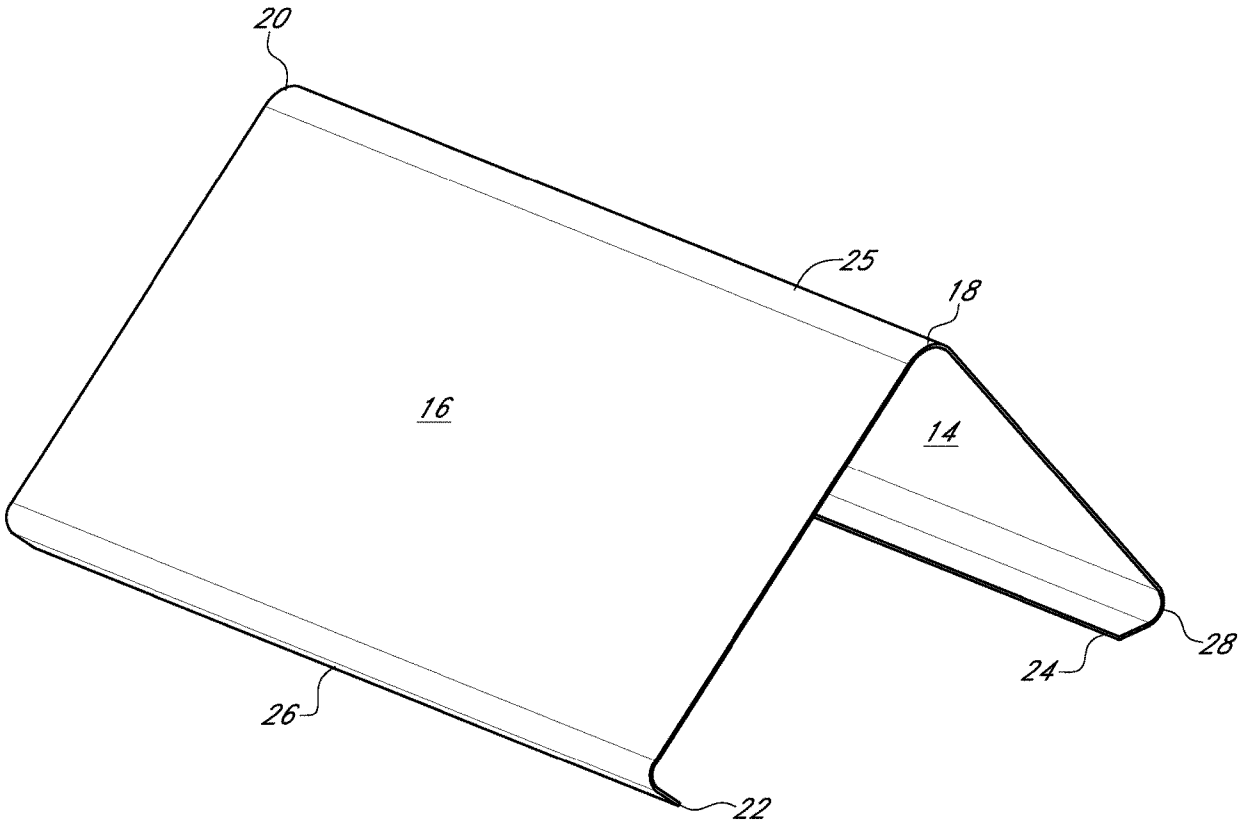
FIG. 1 is a perspective view of a corner shield.
Figure 2:
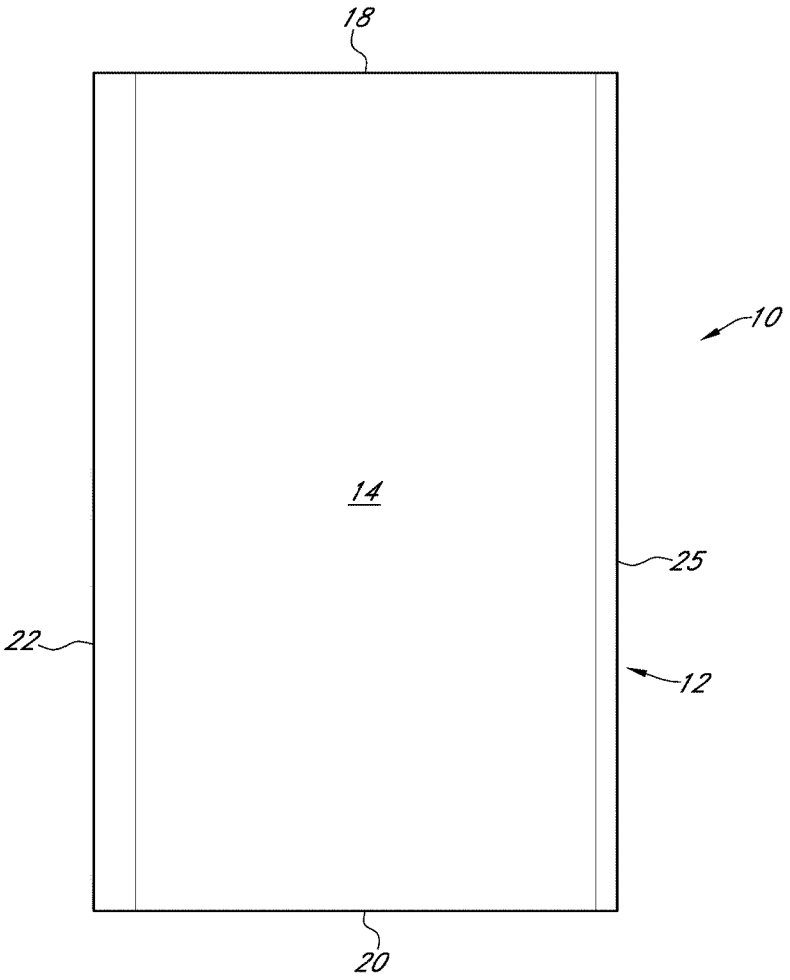
FIG. 2 is a side view of a corner shield.
Figure 3:
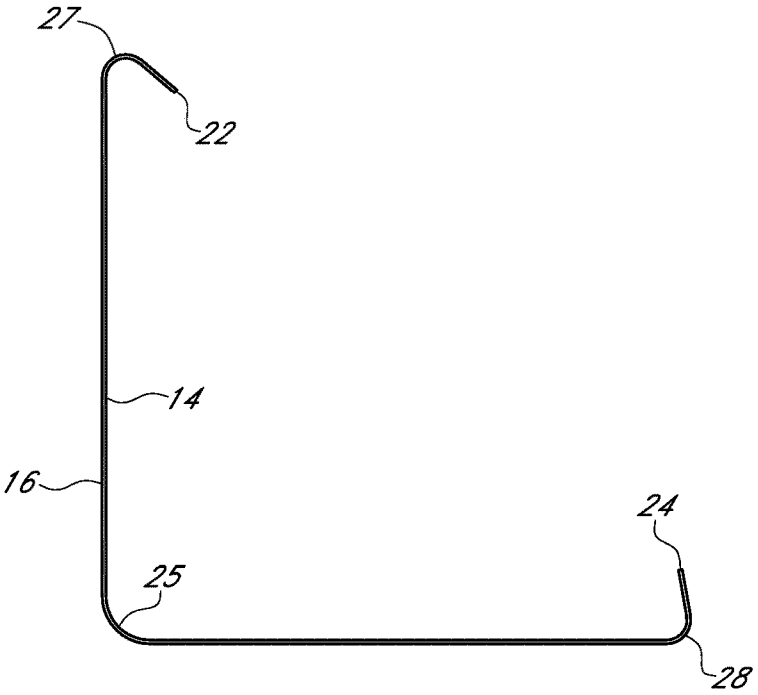
FIG. 3 is an end view of a corner shield.
Figure 4:
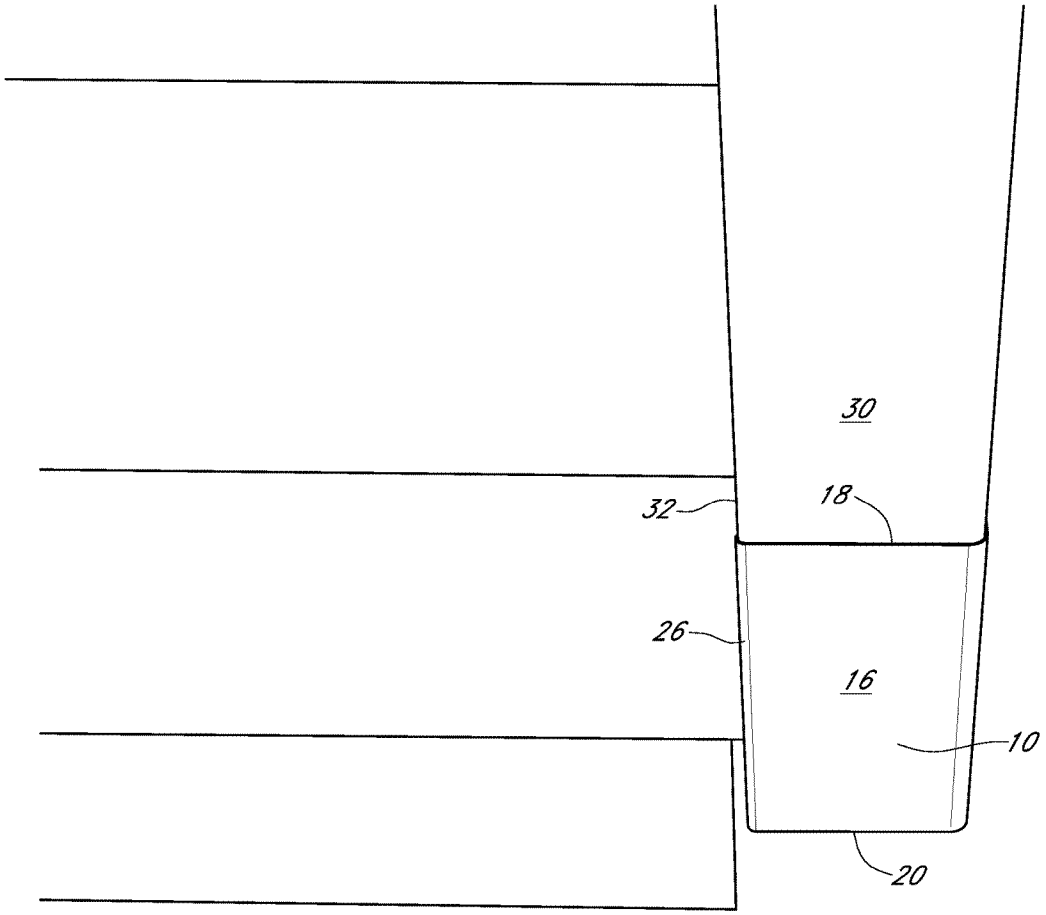
FIG. 4 is a perspective view of a corner shield attached to a corner post.
Figure 5:
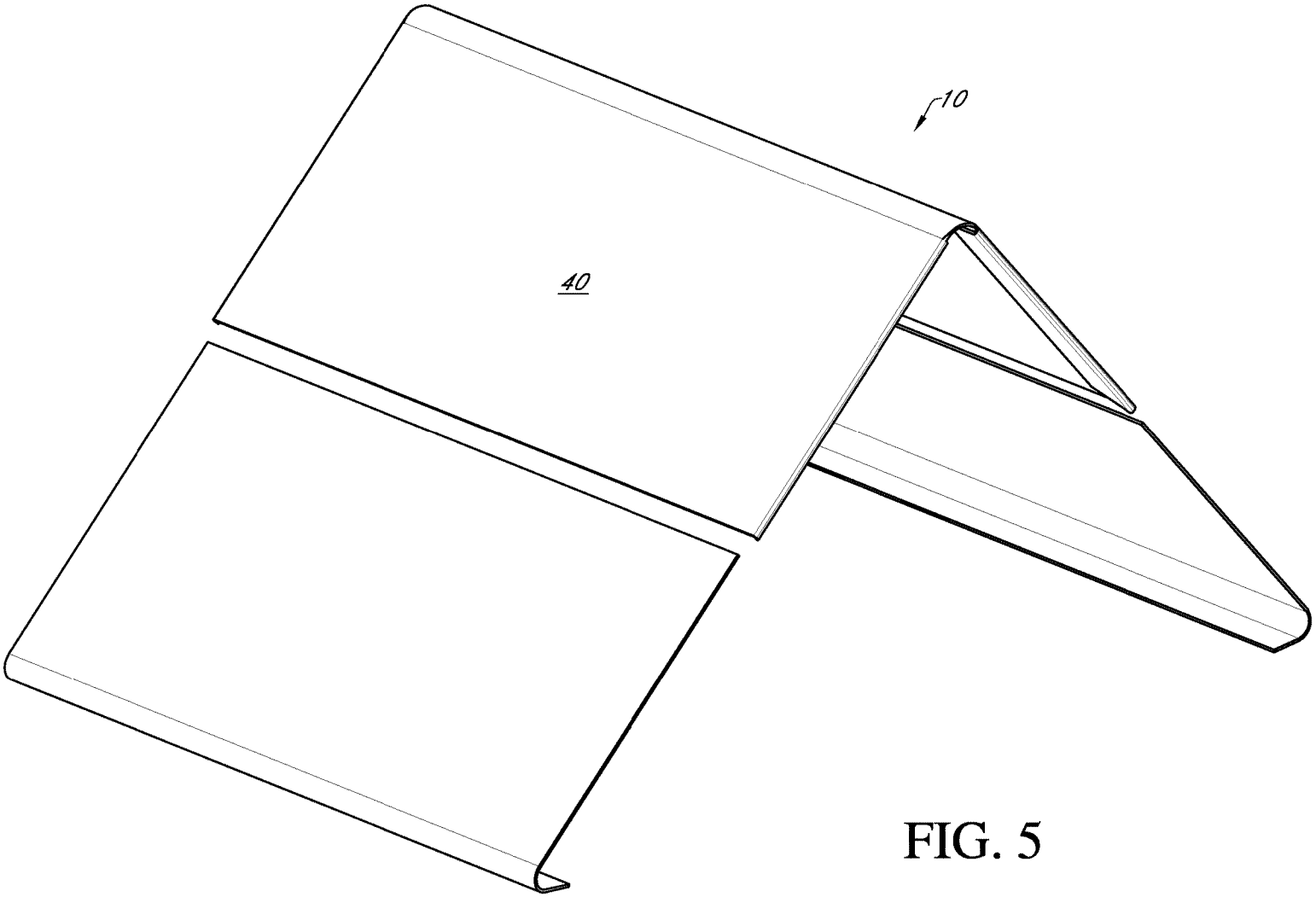
FIG. 5 is a perspective view of a corner shield.
Figure 6:
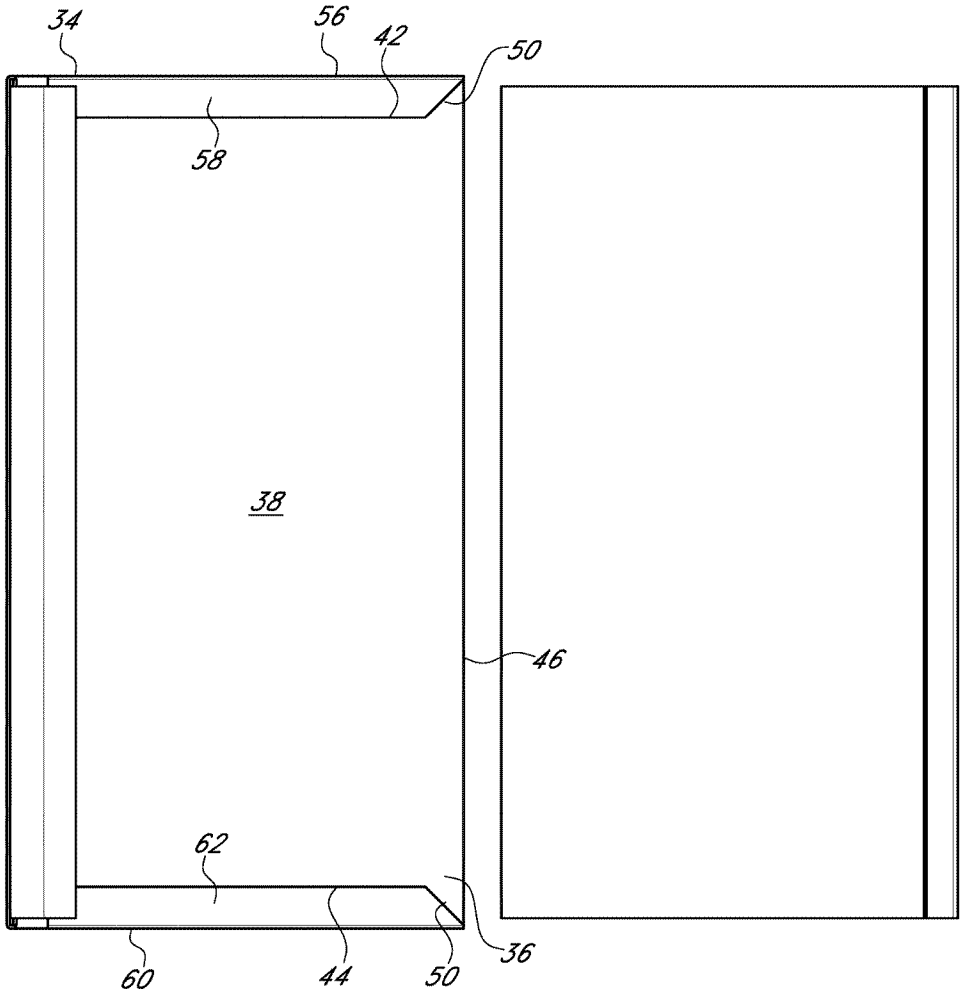
FIG. 6 is a top plan view of a corner shield.
Figure 7:
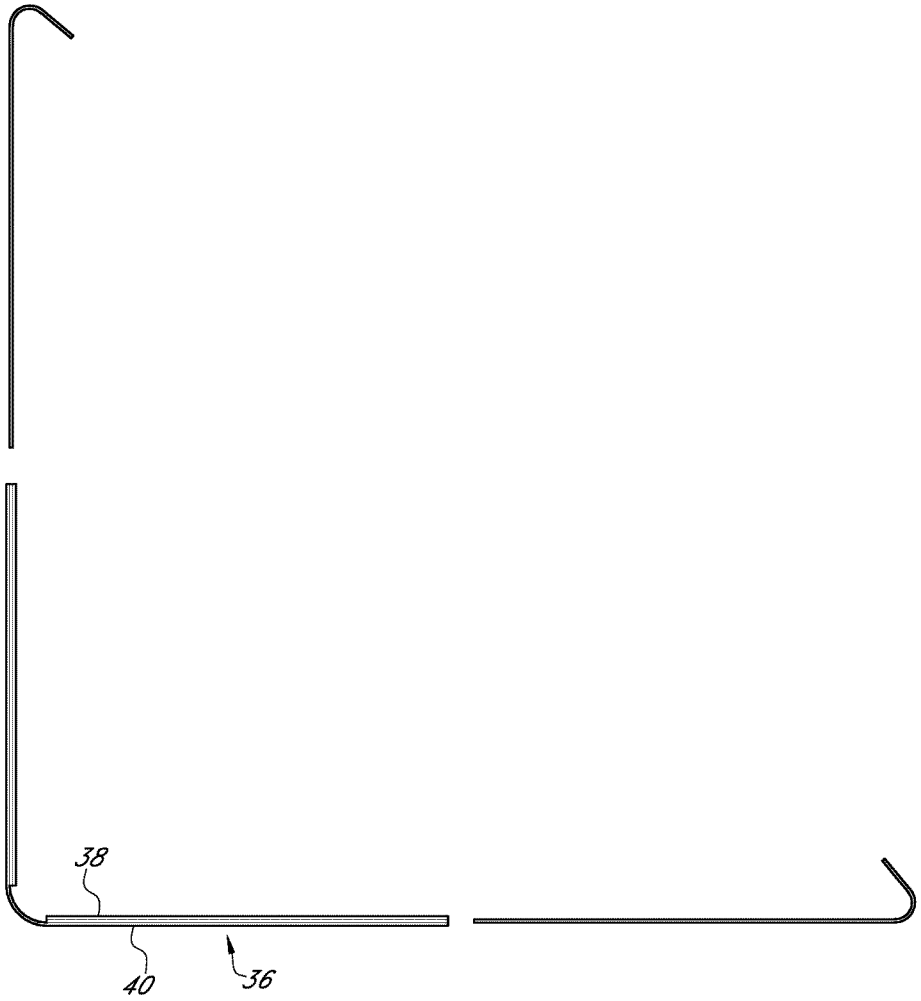
FIG. 7 is an end view of a corner shield.
Figure 8:
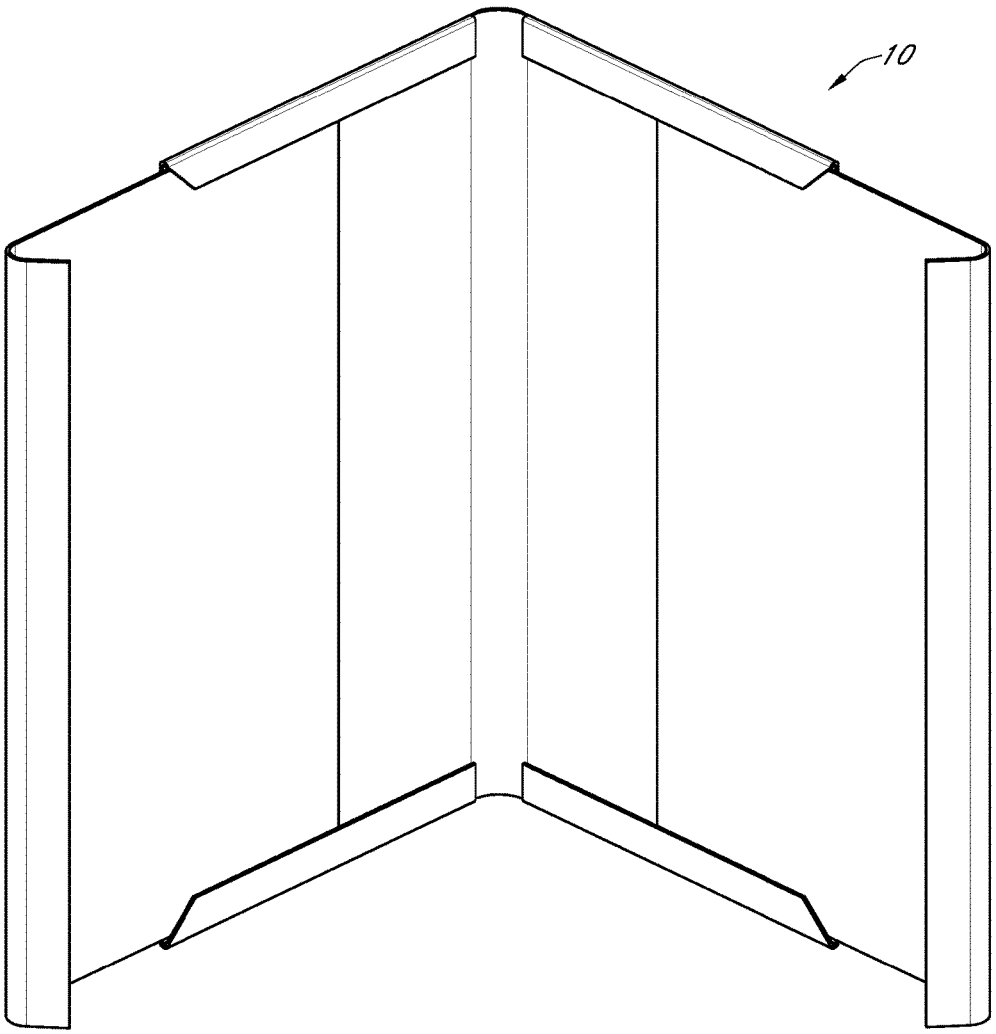
FIG. 8 is a perspective view of a corner shield.

Referring to the Figures, a corner shield 10 is formed from a pliable elongated sheet of material 12 having a first surface 14, an opposite second surface 16, a first top edge 18, a second bottom edge 20, and opposite side edges 22 and 24. While the elongated sheet 12 is of any size, preferred is a sheet 12 having a length of 5 inches and a width of 3⅛ inches.

To form the corner shield 10 the elongated sheet 12 is folded or bent along a first fold line 25 toward the first surface 14. The first fold line 25 extends form the top edge 18 to the bottom edge 20 approximately halfway between side edges 22 and 24. Preferably, the sheet 12 is folded along the first fold line 25 to form a 90 degree angle.

The sheet 12 is then folded or bent along a second fold line 26 toward the first surface 14 and extends from the top edge 18 to the bottom edge 20 adjacent and parallel to side edge 22 to form flap 23. Preferably, the second fold line 26 is ¼ inch from side edge 20 and is folded to form a 50 degree angle.

Next the sheet is folded toward the first surface 14 along a third fold line 28 that extends from the top edge 18 to the bottom edge 20 adjacent and parallel to side edge 24 to form a flap 27. Preferably, the third fold line 28 is ¼ inches from side edge 24 and is folded to form an 80 degree angle.

Once folded, the corner shield 10 is frictionally fitted to a corner post 30 such that flaps 23 and 25 fit around corner edges 32. The size of the sheet and the distance and angles of the flaps can be adjusted to fit different sized corner posts 30.

Alternatively, the corner shield 10 is made of three pieces that are adjustably connected together. The first piece 34 is an elongated sheet 36 of pliable material having a first surface 38, a second surface 40, a top first edge 42, a second bottom edge 44, and side edges 46 and 48. Preferably, sheet 36 has a length of 5¼ inches and a width of 5⅛ inches. To form the first piece 34, a portion 50 of the top edge 42 and the bottom edge 44 are cut out along cut lines 52 and 54. Once cut out, the top edge is folded downwardly toward the first surface 38 along a first fold line 56 to form a first flap 58 and the bottom edge 44 is folded upwardly toward the first surface 38 along a second fold line 60 to form a second flap 62. Flaps 58 and 62 are folded over in such a manner that they form slots 64 and 66 between the first surface 38 and the inner surface of flaps 58 and 62.

The second piece 68 and third piece 70 are the same. Preferably, both have a length of 3 inches and a width of 5 inches. Both also have a first surface 72, a second surface 74, a top edge 76, a bottom edge 78, and side edges 80 and 82. Also, with both, side edge 80 is folded toward first surface 72 along fold lines 84 to form flaps 86 and 88. Fold lines 84 are preferably ¼ inch from side edge 80 and flaps 86 and 88 are folded to form a 50 degree angle.

Once formed, the second 68 and third 70 pieces are adjustably connected to first piece 34. Specifically, side edges 82 are slid into slots 64 and 66 until they are in a desired position. Once positioned, flaps 58 and 62 can be crimped to maintain the desired position. Once positioned, shield 10 is attached to post 30 as previously described.

What is claimed is:

1. A cover shield for a structure, comprising:

a pliable elongated sheet of material folded along a first fold line;

a first flap folded to form a 50 degree angle along a second fold line adjacent and parallel to a first side edge of the sheet;

a second flap folded to form an 80 degree angle along a third fold line adjacent and parallel to a second side edge of the sheet;

wherein the first flap and the second flap are configured to be frictionally fitted to corner edges of a corner post.

2. The shield of claim 1 wherein the first fold line is halfway between the first and second side edges of the sheet.

3. The shield of claim 1 wherein the sheet is folded along the first fold line to form a 90 degree angle.

4. A cover shield for a structure, comprising:

a first piece having a first flap along a top edge and a second flap along a bottom edge that form a first slot and a second slot;

the first piece folded along a first fold line that extends from the top edge to the bottom edge:

a second piece having a top edge, a bottom edge, a first side edge, and a second side edge;

the first side edge of the second piece having a third flap folded along a second fold line;

a third piece having a top edge, a bottom edge, a first side edge, and a second side edge;

the first side edge of the third piece having a fourth flap folded along a third fold line;

wherein the third flap and the fourth flap extends towards each other on the same face of the cover shield as the first flap and the second flap of the first piece;

wherein the second side edge of the second piece and third pieces are slidably and adjustably received by the first slot and the second slot of the first piece such that the first slot of the first piece wraps over the top edge of the second piece and the third piece and the second slot of the first piece wraps over the bottom edge of the second piece and the third piece.

5. The cover of claim 4 wherein a portion of the top edge and the bottom edge of the first piece is cut out.

6. The shield of claim 4 wherein the third and fourth flaps are folded to form 50 degree angles.

7. The shield of claim 4 wherein the second and third pieces are configured to be frictionally fitted to corner edges of a corner post.

8. The shield of claim 4 wherein the first flap and second flap are configured to be crimped such that the position of the second piece and the third piece is maintained.

* * * * *